US005099650A

United States Patent [19]

Crunkleton

[11] Patent Number: 5,099,650

[45] Date of Patent: Mar. 31, 1992

[54] CRYOGENIC REFRIGERATION APPARATUS

[75] Inventor: James A. Crunkleton, Cambridge, Mass.

[73] Assignee: Boreas Inc., Woburn, Mass.

[21] Appl. No.: 515,055

[22] Filed: Apr. 26, 1990

[51] Int. Cl.[5] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,802,211 | 4/1974 | Bamberg et al. | 62/6 |
| 4,143,520 | 3/1979 | Zimmerman | 62/6 |
| 4,277,947 | 7/1981 | Durenec | 62/6 |
| 4,277,948 | 7/1981 | Horn et al. | 62/6 |
| 4,366,676 | 1/1983 | Wheatley et al. | 62/6 |
| 4,498,296 | 2/1985 | Dijkstra et al. | 62/6 X |
| 4,622,823 | 11/1986 | Ishizawa et al. | 62/6 |
| 4,700,545 | 10/1987 | Ishibashi et al. | 62/6 |
| 4,845,953 | 7/1989 | Misawa et al. | 62/6 |
| 4,848,092 | 7/1989 | Gifford | 62/6 |
| 4,969,807 | 11/1990 | Kazumoto et al. | 62/6 X |

*Primary Examiner*—Henry A. Bennett
*Assistant Examiner*—Christopher Kilner
*Attorney, Agent, or Firm*—Robert F. O'Connell

[57] ABSTRACT

A technique for producing a cold environment in a refrigerant system in which input fluid from a compressor at a first temperature is introduced into an input channel of the system and is pre-cooled to a second temperature for supply to one of at least two stages of the system, and to a third temperature for supply to another stage thereof. The temperatures at such stages are reduced to fourth and fifth temperatures below the second and third temperatures, respectively. Fluid at the fourth temperature from the one stage is returned through the input channel to the compressor and fluid at the fifth temperature from the other stage is returned to the compressor through an output channel so that pre-cooling of the input fluid to the one stage occurs by regenerative cooling and counterflow cooling and pre-cooling of the input fluid to the other stage occurs primarily by counterflow cooling.

17 Claims, 5 Drawing Sheets

CRYOGENIC REFRIGERATION APPARATUS

This invention was made with Government support under Contact No. DE-AC02-88ER80598 awarded by the Department of Energy. The Government has certain rights in this invention.

INTRODUCTION

This invention relates generally to cryogenic refrigerant apparatus for providing a fluid at extremely low temperatures and, more particularly, to such an apparatus which uses a technique for permitting such low temperatures to be reached in an efficient manner at reasonable cost in an apparatus the size of which can be relatively small and compact.

BACKGROUND OF THE INVENTION

A common type of small cryogenic refrigerator in use today is one which makes use of the Gifford-McMahon (G-M) operating cycle. This cycle is used in both single and multiple-stage configurations. A basic description of the G-M operation is set forth in U.S. Pat. No. 3,045,436, issued on July 24, 1962 to W.E. Gifford and H.O. McMahon. Other apparatus configurations using G-M principles of operation are also described, for example, in U.S. Pat. Nos. 3,119,237 and 3,421,331, issued on Jan. 28, 1964 and Jan. 14, 1969 to W.E. Gifford and to J.E. Webb, respectively.

In such systems, no heat energy is transferred from the expanding fluid through the performance of mechanical work external to the refrigerator. Thus, while a moveable displacer element is periodically moved within the appartus to provide for an expansion chamber, this element is not arranged so as to produce an external mechanical energy exchange. Rather, as would be well known to those in the art, the displacer moves mass and mechanical energy between confined fluid volumes.

In such an approach, the confined fluid volumes on either end of the displacer are connected by a heat exchange passage, often called a thermal regenerator. The thermal regenerator undergoes the same pressure cycling as the confined fluid volumes. In such a configuration, the heat energy is normally fully stored for a half cycle in the regenerator matrix, which requires the regenerator matrix to have a relatively large heat capacity. In totally regenerative cycles, such as in the G-M approach, the pressure ratio is effectively limited by the gas volume in the regenerator, which volume must be large enough so that the low-pressure-flow pressure drop through the regenerator matrix is not excessive.

Another type of refrigerator well-known to the art and similar in appearance to the Gifford-McMahon type, but different in operation, is one which uses a Solvay cycle of operation. Both the G-M and Solvay techniques use valved, regenerative operating cycles, but the Solvay cycle performs mechanical work extraction from the refrigerant fluid. Thus, the expanding gas at the cold end of a piston performs work on a drive mechanism attached to the other end of the piston. Because of this operation, a Solvay refrigerator requires a high pressure gradient over the piston seal, while the G-M approach, with no work interaction, incorporates only a low pressure gradient over the displacer seal. While the high pressure gradient seal is a significant reliability drawback, the Solvay cycle is normally more efficient than the G-M cycle.

Common regenerator materials have a heat capacity that diminishes at very low temperatures. For this reason, the Gifford-McMahon or Solvay cycles are not capable of producing effective cooling at, for example, liquid helium temperatures, even when multiple stages are used. To reach liquid helium temperatures, a second thermodynamic operating cycle, such as a well-known Joule-Thomson operating cycle, must be used in combination with a Gifford-McMahon cycle, for example. The Joule-Thomson cycle of operation utilizes a pre-cooling counterflow heat exchanger and an expansion valve (commonly referred to as a Joule-Thomson valve). Since neither the G-M, the Solvay, nor the Joule-Thomson cycle is capable of reaching liquid helium temperatures independently, in order to reach liquid helium temperatures, it has been suggested that various appropriate combinations of such techniques be used. Thus, a number of G-M stages can be used to provide for a pre-cooling of the helium gas before it is supplied to the counterflow heat exchanger of the Joule-Thomson operating cycle in preparation for the expansion of the gas during the Joule-Thomson operation. Such a combined cycle configuration could be capable of producing cooling down to liquid helium temperatures. While such a system has been commercially available, it has some severe drawbacks. For example, mechanically combining the two configurations results in a relatively complex physical configuration which is difficult to manufacture, resulting in a system which is often prohibitively expensive for many, if not most, applications. Further, such systems have poor reliability due to clogging of the Joule-Thomson valve and to the difficulty in controlling the operation of such valve. Moreover, the optimal mean cycle pressures and pressure ratios for the two cycles are not compatible, so that the combination requires a specially designed compressor configuration, thereby further increasing the cost and difficulty of manufacture.

A further refrigeration method has been described in U.S. Pat. No. 4,862,694 issued on Sept. 3, 1989 to J.A. Crunkleton and J.L. Smith, Jr. The patent discloses a method for attaining refrigeration at liquid helium temperatures in a relatively simple and compact configuration. One embodiment of the technique discussed therein incorporates a counterflow heat exchange operation which in a preferred embodiment thereof is integral with the piston-cylinder structure thereof. Mechanical work is extracted from the refrigerant gas during the expansion process. One exemplary cycle of operation for a single-stage configuration can be described as follows.

When the piston is in its minimum volume position, an intake valve at room temperature opens to allow high-pressure gas at room temperature to enter the gap between the piston and cylinder. While the gap is charged to full pressure, the intake valve remains open and the piston begins to move, thereby drawing more high pressure gas into the expansion space created below the piston. The constant high-pressure intake continues until the inlet valve is closed. At this time, the expansion portion of the cycle begins. When the piston is at the maximum expanded volume position, a cold exhaust valve opens and the blow-down portion of the exhaust occurs. Movement of the piston then decreases the expansion volume in order to exhaust gas at constant pressure. At the appropriate piston position, the exhaust valve closes and recompression begins. When the piston reaches a position near minimum volume, the intake valve opens and the cycle is repeated.

The gas, which has been exhausted through the cold exhaust valve, enters a surge volume. This volume, coupled with the flow restriction in the low-pressure return flow path between the cylinder and outer shell, results in an effective resistive-capacitive circuit flow arrangement. Accordingly, the mass flow rate in the return flow path is more nearly constant during the cycle period. The gas exits the surge volume and enters the low-pressure return flow passage between the cylinder and outer shell. As the low pressure gas is travelling at a nearly constant rate between the cylinder and the outer shell, it is exchanging heat with gas flowing between the piston and cylinder. Highly efficient counterflow heat transfer occurs to cool the high pressure gas entering the expansion space in preparation for the next expansion stroke.

Such a method of refrigeration is also described as one which can be performed in multiple stages. Typically, high pressure gas enters at room temperature and is pre-cooled as it flows through one or more upper expansion volume stages on its way to the coldest expansion volume stage. The piston is arranged to have a stepped configuration so that, as it moves during the intake and expansion portions of the cycle, such movement would create a number of expansion volumes of varying temperature. During the exhaust phase, gas would flow through the exhaust valves at each of the stages of expansion.

While the system described in the aforesaid Crunkleton and Smith patent operates satisfactorily, it requires a number of "cold" valves, i.e., valves which operate at low temperatures, one at each operating stage. Such valves not only are costly, but also have lower reliability than valves designed for use at warmer temperatures, e.g., at or near room temperature. It is desirable to provide an improved technique which produces effective and reliable operation at extremely low temperatures and which has relatively low manufacturing and operating costs.

The present invention recognizes that, while counterflow heat exchange is essential for attaining liquid helium temperatures at the coldest expansion stage, it is not required for the warmer stages. At temperatures above about 20° K., for example, the heat capacity of the heat exchanger materials is large compared to the net enthalpy flux of the helium through the heat exchanger over a half cycle so that the regenerative heat exchange operation can be efficient above about 20° K. but is much less efficient below such temperature.

The refrigeration method of this invention combines the simplicity and efficiency of regenerative heat exchange for the warmer stages of a multi-stage cooling device with highly efficient counterflow heat exchange at the colder stage or stages. In addition, the warmer expansion stages no longer require individual cold exhaust valves at each expansion stage, thereby increasing reliability of the system and lowering its cost.

BRIEF SUMMARY OF THE INVENTION

The invention is a multi-stage refigeration device, having at least two and, preferably, more than two operating stages. The coldest stage operates at temperatures where the heat capacity of the heat exchanger materials of the device is small compared with the enthalpy flux of the helium.

In accordance with an exemplary two-stage embodiment of the invention, for example, displacement or expansion volumes at each stage are periodically recompressed to a high pressure by reducing the displacement volume in each stage to substantially zero or near zero volume. By opening an inlet valve at the warm (e.g., at or near room temperature) end of an input channel, and by increasing the displacement volumes, further fluid under pressure, as supplied from an external compressor, is caused to flow into the input channel at a first relatively warm temperature (e.g., at or near room temperature). The fluid that has been introduced into the input channel is pre-cooled by regenerative and counterflow cooling as it flows through the input channel to the first stage displacement or expansion volume at which region it has been pre-cooled to a second temperature below the first temperature. A further portion of the incoming fluid and residual fluid from the previous cycle continues to flow past the first expansion volume and continues to flow in the input channel to the second stage displacement or expansion volume at the cold end of the channel. This latter fluid portion is further pre-cooled primarily by counterflow cooling as well as by some regenerative cooling as it flows in the input channel to the second expansion volume at a third temperature below the second temperature.

The displacement volume at the first stage, i.e., a "warm" stage, is increased, i.e., expanded, so that the compressed fluid therein is expanded from the high pressure at which it had been pressurized to a substantially lower pressure so as to reduce the temperature of the fluid in or near the "warm" displacement volume to a fourth temperature which is substantially lower than the second temperature, but generally higher than the third temperature.

The displacement volume at the second stage, i.e., the "cold" stage, is increased simultaneously with that of the first stage to form an expanded volume at the second stage so that the compressed fluid therein is expanded from the high pressure at which it had been pressurized to a substantially lower pressure so as to reduce the temperature of the fluid in or near the "cold" displacement volume to a fifth temperature which is substantially lower than the third temperature.

At the end of the expansion stroke (maximum volume), the warm exhaust valve and/or the cold exhaust valve open(s), which will result in blowdown if a pressure difference exists over the valve(s) before opening. Although both exhaust valves are opened during some period of blowdown and constant-pressure exhaust, the valves are not necessarily opened or closed at the same timing.

The displacement volume at the warm stage is decreased and the low pressure expanded fluid therein is caused to flow back into the input channel from the first stage displacement volume, toward the inlet end of the input channel and thence outwardly therefrom through a "warm" output valve thereat, a portion thereof also flowing to the cold stage.

Further, the very low temperature, low pressure, expanded fluid which is used to produce the cold environment at the second stage is caused to flow from the "cold" displacement volume, as a result of the decrease in such displacement volume, into an output channel via a "cold" valve and a surge volume thereat, a portion thereof also flowing through the input channel to the warm stage. The very low temperature expanded fluid, which may be two phase, for example, is used to produce a cold environment for a heat load applied thereto, heat being transferred from the environmental heat load to the expanded fluid thereby boiling the two-phase fluid and/or warming the gaseous fluid and cooling the environment. A further heat load may be applied to the warm stage for cooling thereof also.

The fluid, which is caused to flow over a first time duration from the "warm" first stage displacement volume at the fourth temperature towards the inlet end of the input channel and through the warm output valve thereat, is in intimate contact with the warmer surfaces of the piston and cylinder used in the device for changing the displacement volumes and exchanges heat with these warmer surfaces thereby warming the fluid exiting from the warm output valve and cooling the piston and cylinder in preparation for the following cycle. This type of heat exchange is commonly referred to as regenerative heat exchange. Simultaneously with such operation, but over a second longer time duration, the expanded low temperature, low pressure fluid from the "cold" displacement volume is caused to flow in the output channel at a substantially constant flow rate and at a substantially constant pressure to a fluid exhaust exit at the warm output end of the output channel. During operation, direct counterflow heat exchange is provided between the input and output channels to produce a pre-cooling of incoming fluid in the input channel and a warming of the fluid in the outlet channel to a temperature at or near the first temperature, less allowance of a heat exchange temperature difference prior to its exit therefrom. The warm exiting fluid from both the input and output channels is compressed, as by being supplied to an external compressor system, so as to supply fluid under pressure from the compressor system for the next operating cycle.

Residual portions of the expanded fluid which resulted from the expanded operation of a previous cycle remain in the displacement volumes and in the input channel. Such remaining fluid may undergo recompression if the warm and cold exhaust valves are closed before minimum displacement volumes are reached. The device is now ready to execute the next expansion cycle. The compressed fluid from the compressor system is next supplied via the input channel to the first and second stage displacement volumes. The fluid flowing to the first stage displacement volume is pre-cooled by regenerative heat exchange with the piston and cylinder structures, and by counterflow cooling by the cold fluid flowing in the output channel. The fluid flowing to the second stage displacement volume is primarily pre-cooled by counterflow heat exchange with the cold fluid flowing in the output channel, although there may be some, but much less, pre-cooling due to regenerative cooling.

The overall compression, intake, expansion, and exhaust process is then repeated, the fluid in the displacement volumes and in the input channel being again periodically compressed and the expansion thereof occurring as before.

Such an approach permits an efficient heat exchange over a relatively wide temperature range to be implemented in a relatively compact manner, i.e., in a relatively small scale device. As such a device is scaled down in size, the amount of surface area available for heat exchange per unit volume becomes comparable with the area required for efficient heat exchange so that, even for reasonably small and compact scale configurations, the overall system readily provides the necessary heat transfers to produce efficient operation. There being good thermal connections between the input and output channels, the fluid flowing to the cold stage enjoys the benefits of efficient counterflow heat exchange. The warmer stage, where the heat capacity of the structural materials of which the warm stage is constructed is large compared to the convective heat flux of the fluid, enjoys the benefits of both regenerative and counterflow heat exchange.

The size of the heat load (i.e., the applied heat load or parasitic heat leaks) at either stage has a relatively large impact on the type of heat exchange operation at the warm stage. If the heat load at the cold stage is much smaller than that at the warm stage, regenerative heat exchange dominates at the warm stage. If the heat load at the cold stage is relatively larger than that at the warm stage, counterflow cooling may account for most of the heat exchange at the warm stage. This is because a relatively larger heat load on the cold stage requires more mass flow to the cold stage. This larger mass flow rate returns to the compressor primarily through the output passage, which results in more counterflow heat exchange on the warm stage.

In a system of the invention which uses more than two stages, in the warmer stages, i.e., those generally at about 20° K. and above, heat transfer occurs between the fluid and structural material (a regenerative heat exchange operation), as well as between fluid flowing in the separate input and output cooler channels (counterflow operation). Fluid flowing in the output channel originates only from the colder stages having a connection (e.g., a valve) between the input and output channels. Thus, the technique of the invention is able to achieve the high cold-temperature efficiencies of the refrigeration method described in the Crunkleton and Smith patent but also benefits further from the inherent simplicity of warmer refrigeration techniques of the type used in Gifford-McMahon or the Solvay operations.

DESCRIPTION OF THE INVENTION

The invention can be described in more detail with the help of the drawings wherein.

Figure 1:
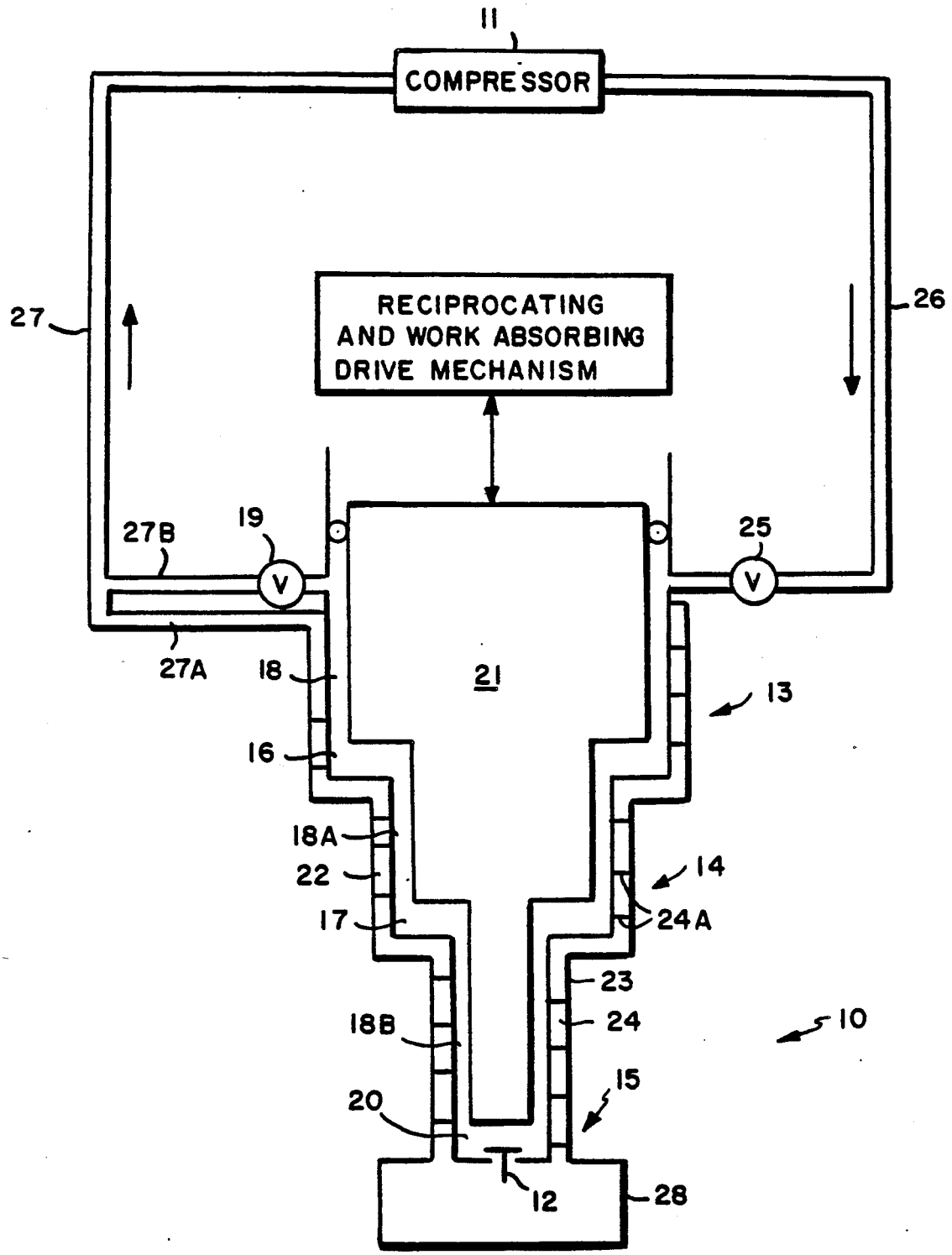
FIG. 1 shows a diagrammatic view of one embodiment of a refrigeration system in accordance with the invention.
Figure 1A:
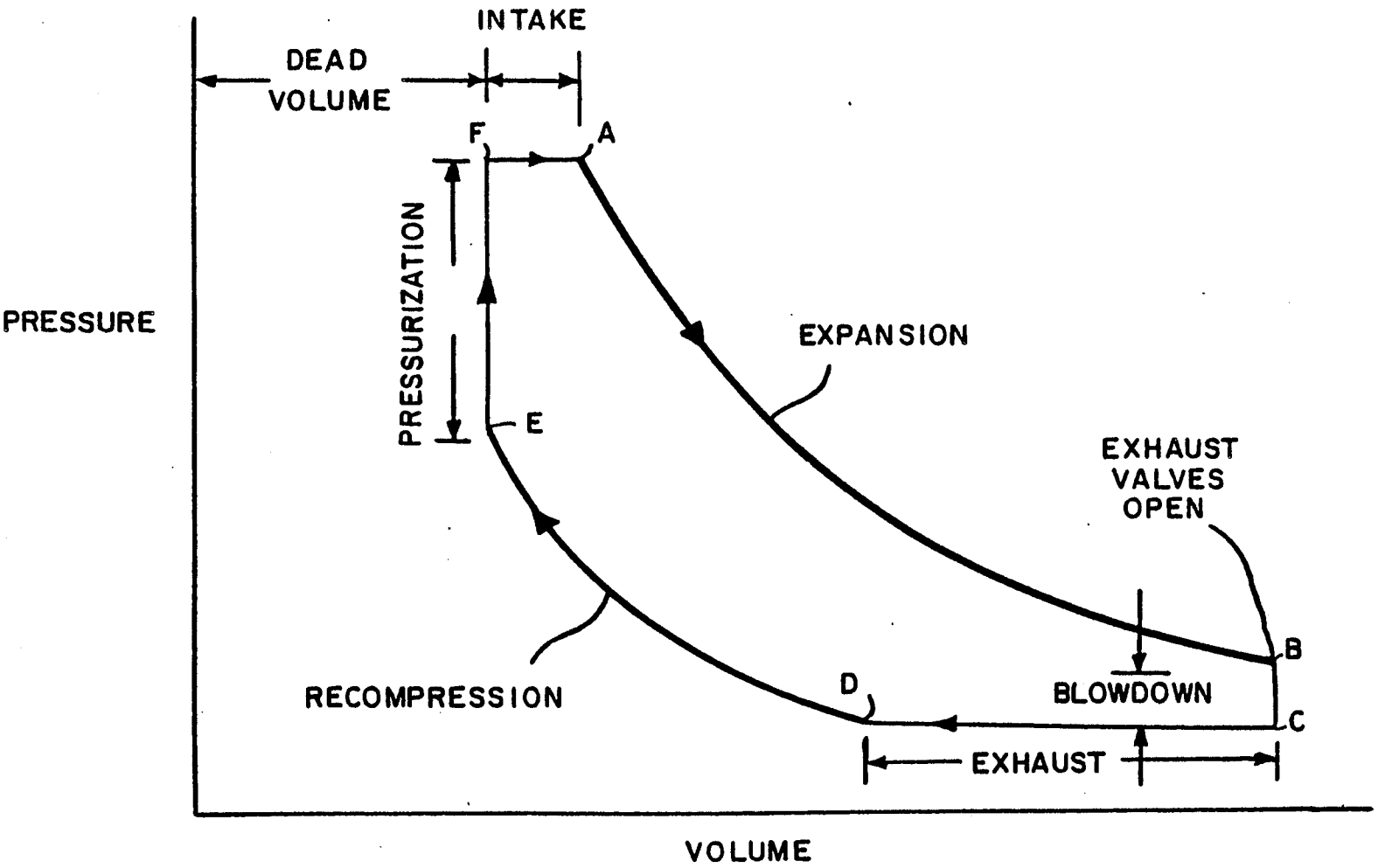
FIG. 1A shows a pressure-volume plot helpful in explaining the operation of the system depicted in FIG. 1.

The system 10, shown in FIG. 1, utilizes a conventional compressor system 11 and represents a particular embodiment of the invention having a three-stage refrigeration configuration requiring only a single cold exhaust valve 12 at the coldest operating stage 15. FIG. 1A depicts a typical pressure-volume (P-V) plot for explaining the operation of the system of FIG. 1. The upper two stages 13 and 14 use both regenerative pre-cooling by the piston-to-cylinder gap regenerators, i.e., the walls of piston 21 and cylinder 22, and counterflow pre-cooling due to flow of cold fluid from the coldest stage 15. A portion of the fluid in the upper two stages enters and also leaves the displacement volumes 16 and 17 thereof via the same flow passage or input channel 18. A "warm" exhaust valve 19 is needed at or near room temperature to exhaust low-pressure fluid from displacement volumes 16 and 17 via input channel 18. A "warm" inlet valve 25 at or near room temperature allows high pressure gas to enter input channel 18, when open, for the pressurization and intake portions of the operation, as discussed below with reference to FIG. 1A.

Fluid flows to the cold displacement volume 20 in stage 15 which uses primarily counterflow heat exchange, as described below, to overcome the diminishing specific heat of the heat exchanger walls which provides the regenerative cooling in the warmer stages. The fluid to be expanded in the coldest stage 15 receives its initial pre-cooling in the upper two stages. Fluid flows to displacement volume 20 during intake and expansion. Fluid leaves displacement volume 20 primarily through "cold" exhaust valve 12 when it is opened and also through channel portion 18B of channel 18 during recompression or when warm exhaust valve 19 is open and cold exhaust valve 12 is closed.

In the two upper stages, following expansion, the low-pressure return fluid flowing upwardly to valve 19 via input channel 18 formed between the wall of piston 21 and the cylinder wall 22 cools the piston wall and such cylinder wall so that when high pressure fluid subsequently enters input channel 18, it is then primarily pre-cooled by such structures in a regenerative cooling heat exchange operation. Such fluid is also pre-cooled by the very cold return fluid counterflowing in output channel 24 from the coldest stage 15. As discussed in the aforesaid Crunkleton and Smith patent, channel 24 may utilize a helical spacer element 24A to separate its outer wall 23 and its inner wall 22 (i.e., the outer wall of channel 18). Both regenerative and counterflow heat exchange occurs in the channel between the piston and cylinder walls at the upper two stages 13 and 14. Since the specific heat capacity of such heat exchanger walls is very small at very low temperatures, e.g., below about 20° K., pre-cooling of the fluid flowing in channel 18B to the coldest stage 15 occurs primarily due to counterflow heat exchange with the very cold counterflowing fluid in output channel 24. It should be noted that the exhaust valve 19 operates at a relatively warm temperature, e.g., at or near room temperature, so that the development and packaging of such a room-temperature valve is much less difficult and less costly than for a cold valve. Moreover, such warm valve can be located where it is readily accessible so that maintenance or service thereof is much easier than it would be for a cold valve, i.e. one operating substantially below room temperature.

In the operation of FIG. 1, as explained with reference to the pressure/volume plot of FIG. 1A, fluid at high pressure and relatively warm temperature, e.g., at or near room temperature, is supplied from compressor system 11 via high pressure channel 26 to an inlet valve 25 for supply to input channel 18 beginning at point E. The input channel 18, including channel portion 18A and 18B, is pressurized to the pressure shown at point F by the incoming high-pressure fluid. At point F the piston 21 begins to move to increase the volumes of displacement volumes 16, 17 and 20 from point F to point A. The high pressure fluid, pre-cooled in input channel 18, flows to upper displacement volume 16 of stage 13, to intermediate displacement volume 17 of stage 14, and thence to lower expansion volume 20 of stage 15.

Inlet valve 25 remains open and piston 21 moves to increase the volumes of displacement volumes 16, 17 and 20 and high pressure fluid is supplied by compressor system 11 until the inlet valve 25 closes at point A of FIG. 1A, at which point the expansion portion of the cycle begins. During the expansion portion of the cycle, the piston 21 is moved upwardly, and the volume increases or expands and the pressure drops (from point A to point B in FIG. 1A).

Either or both exhaust valves 12 and 19 open at point B and an initial "blowdown" stage (point B to point C) occurs. Movement of piston 21 to reduce the volume during the subsequent exhaust portion of the cycle and opening of valve 12 forces low pressure, very cold fluid from displacement volume 20 through opened exhaust valve 12 into output channel 24 via surge volume 28 for flow to outlet channel 27 via interconnecting channel 27A (from point C to point D in FIG. 1A). Low pressure return fluid from volumes 16 and !7 is also forced upwardly back through input channel 18 via channel portion !8A into channel 27 via open exhaust valve 19 and interconnecting channel 27B. The return low pressure fluids from channels 27A and 27B are combined in channel 27 and supplied to a compressor system 11.

During the return flow of the cooled fluids from expanded displacement volumes 16 and 17 to valve 19, a regenerative heat exchange occurs between such fluids in input channel portions 18 and 18A and the warmer walls of piston 21 and cylinder 22. The warm exhaust valve 19 closes after a first time period (at some time between point B and point D) and the cold exhaust valve 12 closes after a second time period which may be shorter or longer than the first time period. Both valves 12 and 19 are closed by point D. Recompression of the return fluid occurs (point D to point E in FIG. 1A) as the piston 21 moves so as to further reduce the displacement volumes 16, 17 and 20. The inlet valve 25 opens after the recompression portion of the cycle (at point E) to permit the intake of high pressure fluid, e.g., at or near room temperature, from compressor system 11 into input channel 18, thereby further increasing the pressure (from point E to point F), the volume remaining substantially the same.

As the incoming high pressure fluid flows into and through channel portions 18 and 18A, the cooled walls of piston 21 and cylinder 22 pre-cool the flowing fluid by a regenerative cooling process in stages 13 and 14 so that the fluid reaches volumes 16 and 17 at temperatures progressively lower than room temperature. The low pressure cold fluid present in output channel 24 produces further heat exchange with, i.e., a counterflow cooling of, the high pressure fluid which flows through channel 18 and 18A to volumes 16 and 17.

The remaining high pressure fluid which flows through input channel portions 18B to volume 20 is further pre-cooled substantially entirely by counterflow cooling due to the low pressure, very cold return fluid counterflowing in output channel 24. Thus, the high pressure fluid temperatures at volumes 16, 17 and 20 are progressively cooler due to the regenerative and counterflow pre-cooling in stages 13 and 14 an due primarily to the counterflow pre-cooling in stage 15.

The piston moves to increase the volume (from point F to point A) during which time period more high pressure fluid mass is supplied in volumes 16, 17 and 20. At point A the expansion cycle is ready to be repeated in the manner discussed above.

Figure 2:
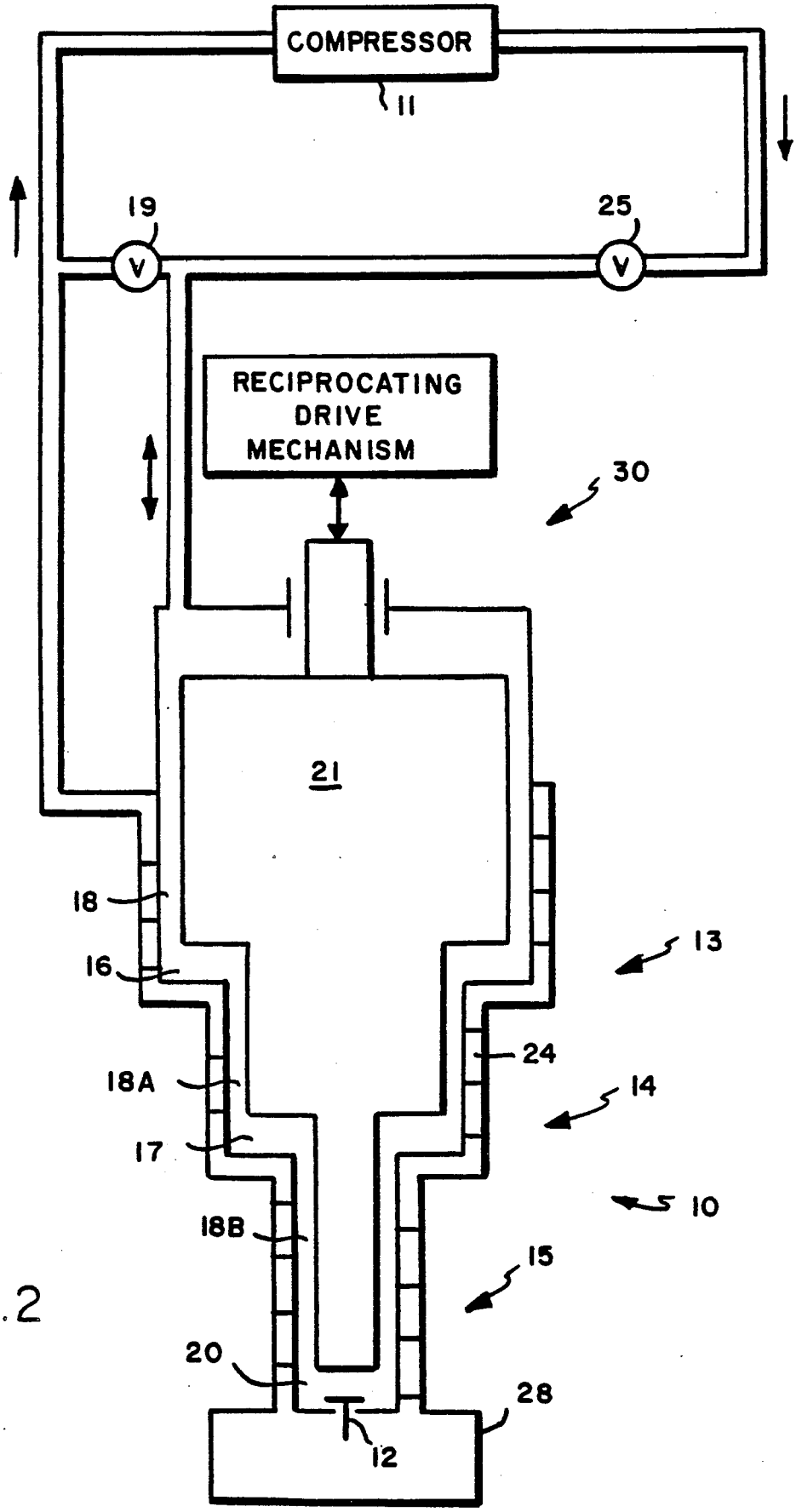
FIG. 2 shows a diagrammatic view of an alternative embodiment of a system in accordance with the invention.
Figure 2A:
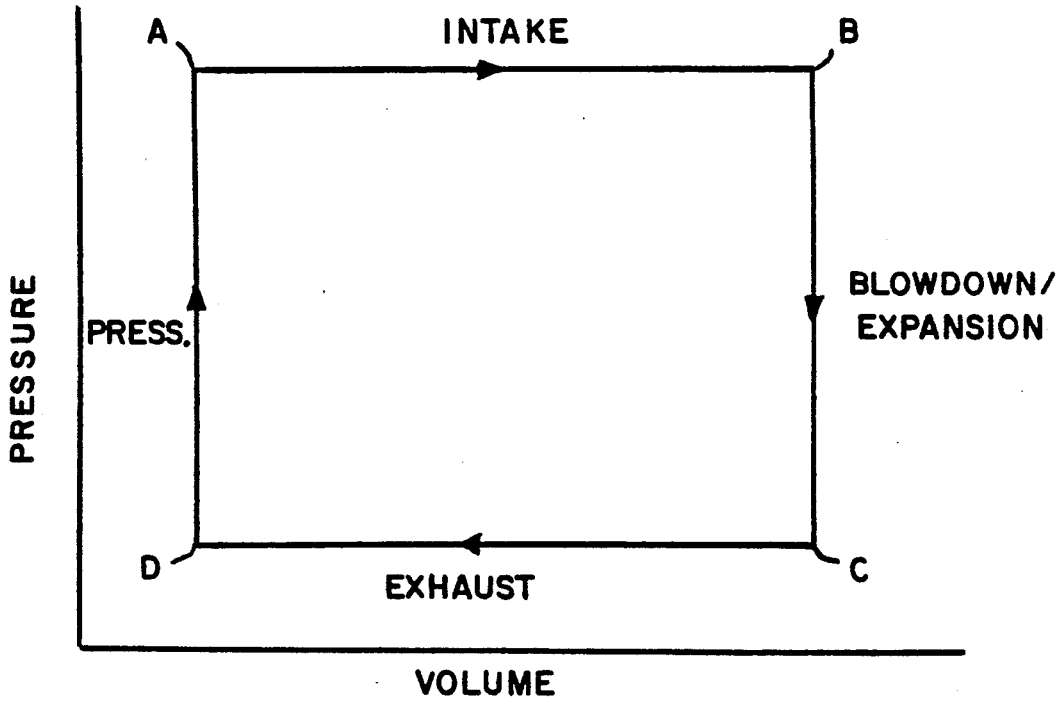
FIG. 2A shows a pressure-volume plot helpful in explaining the operation of the system depicted in FIG. 2.

Another configuration of the invention using a pressure-balanced displacer 30, rather than a reciprocating work absorbing and drive mechanism as in FIG. 1, is shown in FIG. 2. The operation of such a system, as depicted by the P-V plot shown in FIG. 2A, is different from that depicted in FIG. 1A. Use of the pressure-balanced displacer, as would be well known to those in the art, eliminates the need for a work absorbing and drive mechanism and results in a simpler drive mechanism. For example, the displacer can be driven by allowing the pressure force on the displacer to become unbalanced at appropriate points in the cycle by using a balancing chamber at the mean operating pressure. In most cases, however, the drive mechanism for displacer motion is powered in a reciprocal manner by a rotary stepping motor using a suitable scotch yoke mechanism, as would be known to the art. The same rotary motor is used to operate the inlet and warm exhaust valves 25 and 19, respectively.

In FIG. 2, the warm exhaust valve 19 and the cold exhaust valve 12 open to allow for depressurization of the working volumes while the displacer moves to decrease the volume of the working space. The amount of flow from the cold expansion stage 15 depends on how long the cold exhaust valve is open. The flow resistance from the cold expander volume 20 to the surge volume 28 is assumed to be considerably less than that in the displacer-to-cylinder gap during low-pressure exhaust.

As seen in the P-V plot of the system of FIG. 2, as shown in FIG. 2A, a constant pressure intake portion of the cycle occurs from point A to point B, the inlet valve 25 being open and displacer 21 moving so as to increase the volume, the pressure remaining substantially constant. At point B the inlet valve 25 closes and at least one of the exhaust valves 12 or 19 opens. An expansion (effectively a blow down expansion) portion of the cycle occurs from point B to point C, the other exhaust valve opening at some point therebetween so that by point C both exhaust valves 12 and 19 are open. The cold fluid flows from stage 15 through output channel 24 via valve 12 and surge volume 28, the piston moving so as to reduce the volume during the exhaust portion of the cycle from point C to point D. By point D, both exhaust valves 12 and 19 are closed and at D the inlet valve 25 opens. The pressurization portion of the cycle occurs from point D to point A as a result of the operation of compressor system 11 and the intake of high pressure fluid therefrom into input channel 18, while the cold volume remains substantially constant.

Pre-cooling of fluid flowing in input channel portions 18 to 18A to stages 13 and 14 occurs via a regenerative cooling process, as in the system of FIG. 1, together with pre-cooling occurring due to a counterflow heat exchange with the return cold fluid flowing in output channel 24. Further pre-cooling of the fluid flowing in input channel portion 18B to stage 15 also occurs substantially by counterflow heat exchange with the return cold fluid, as in the system of FIG. 1, when using a pressure-balanced displacer as in FIG. 2.

Figure 3:
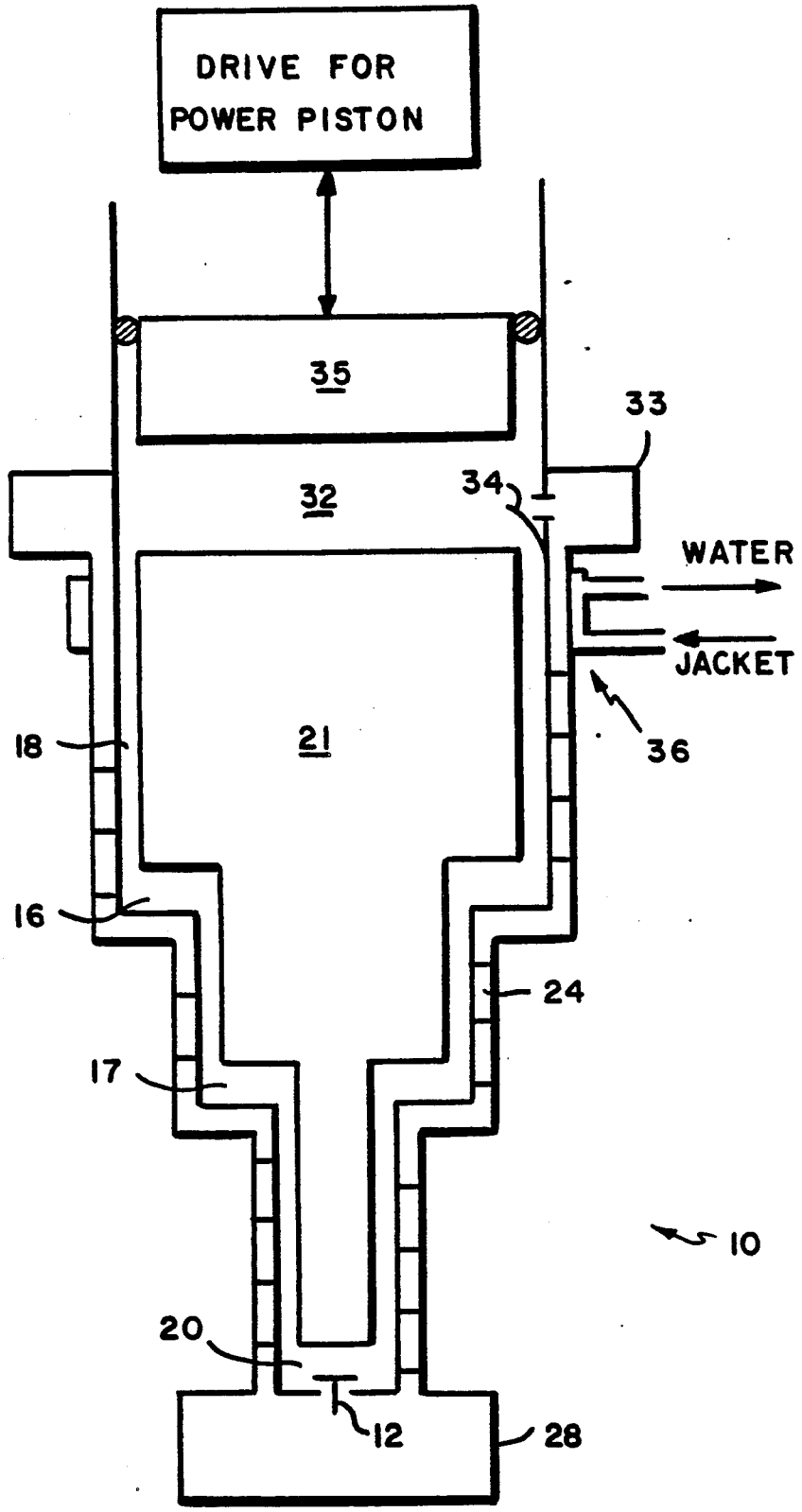
FIG. 3 shows a diagrammatic view of another alternative embodiment of a system in accordance with the invention.
Figure 3A:
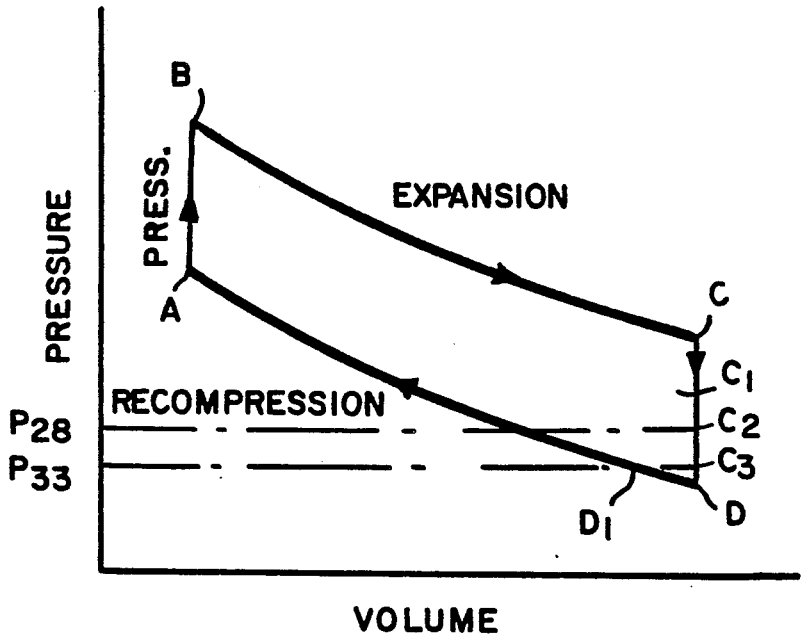
FIG. 3A shows a pressure-volume plot helpful in explaining the operation of the system depicted in FIG. 3.

Valve losses occurring in the configuration of FIG. 2 can be avoided by use of a Stirling-type compression technique, as shown in still another embodiment of the invention as depicted in FIGS. 3 and 3A. The compressor system 11 is replaced by a compression technique which uses a power piston 35 to compress the fluid in compressor working volume 32, channel 18 and displacement volumes 16, 17 and 20. Return fluid from output channel 24 flows into volume 32 via surge volume 33 and open flapper valve 34, while return fluid in input channel 18 flows directly into volume 32. Power piston 35 and displacer 21 operate at the same speed but out of phase with each other.

FIG. 3A effectively depicts the P-V plot of a cycle of operation of the system of FIG. 3 with respect to the overall volume represented by the compression working volume 32, the volumes 16, 17 and 20 and that of input channel 18. As seen therein, at point A, power piston 35 stops and displacer 21 moves to reduce the volumes 16, 17 and 20 to their lowest levels thereby keeping the overall volume constant and increasing the pressure as the fluid warms as it moves from cold to warm locations. During this time flapper valve 34 is closed, since the pressure in volume 32 is greater than that in surge volume 33. Displacer 21 moves so as to increase the pressure (from point A to point B), although the overall volume remains the same during the pressurization portion of the cycle.

Next, the power piston 35 moves so as to increase the overall volume and reduce the pressure, as shown by the expansion portion of the cycle (from point B to point C). At point C, the power piston 35 has reached its topmost position and the volume is at its maximum level. From point C to point D, the displacer 21 moves and, at the same time, during such time interval, the pressure in volume 32 at some displacer position becomes lower than that in surge volume 33 so that flapper valve 34 opens. Piston 35 moves downwardly during the recompression portion of the cycle (from point D to point A).

Operation of cold exhaust valve 12 and flapper-type valve 34 to effect flow may be explained as follows. Surge volumes 28 and 33 in conjunction with the flow resistance in output channel 24 provide an effective hydraulic equivalent of a resistance-capacitance (R-C) circuit arrangement which results in substantially constant pressure, constant flow in channel 24. Surge volume 28 is at a higher average pressure than surge volume 33. In a typical operation, for example, cold exhaust valve 12 opens at point Cl and exhausts cold fluid to surge volume 28 (at pressure P28) until the pressure in volume 20 and volume 28 are equal, at which time the cold exhaust valve 12 closes at point C2. At some later time, the pressure in surge volume 33 (pressure P33) is higher than that in volume 32 (at point C3), so the flapper-type valve 34 opens and fluid flows from surge volume 33 to volume 32 until the pressures in the volumes are equal and the valve 34 closes (at point D1). Beginning at point A, the cycle repeats, starting with the pressurization portion of the cycle from point A to point B.

When power piston 35 reduces the overall volume, the fluid therein compresses and the low-pressure channel 24 and surge volume 33 are isolated from volume 32 by the closed externally controlled cold exhaust valve 12 and by the closed flapper valve 34.

The configuration of FIG. 3 can be considered to be effectively equivalent to a Stirling-type cooler with a counterflow loop superimposed thereon in order to reach liquid-helium temperatures. In the configurations, discussed above in FIGS. 1 and 2, an aftercooler is generally needed in the compression system 11 to cool the compressed gas, which is normally at a relatively high temperature, to a temperature at or near room temperature, techniques for doing so in compression system 11 being well known to those in the art. In the configuration of FIG. 3, however, a heat exchanger at the warm end (e.g., a water jacket 36) can be used to remove energy from, and to cool, the compressed fluid at input channel 18 to room temperature. Although the compressed fluid (which is to be cooled) is separated from such water jacket heat exchanger by the low-pressure return fluid in the output channel 24, heat transfer from the fluid in channel 18 via the return fluid in channel 24 to such heat exchanger can be very effective so as to cool the high pressure fluid to the desired room temperature level.

While the embodiments discussed represent preferred embodiments of the invention, modification thereto and other embodiments thereof may occur to those in the art within the spirit and scope of the invention. Hence, the invention is not to be construed as limited to the specific embodiments disclosed herein, except as defined by the appended claims.

What is claimed is:

1. A method of producing a cold environment using at least two stages of operation in a refrigerant system, said method comprising the steps of:

(a) periodically introducing into an input channel of said system a fluid under pressure at a first temperature for supply to displacement volumes in said at least two stages;

(b) pre-cooling the fluid flowing to the displacement volume of at least one of said at least two stages to a second temperature below said first temperature;

(c) pre-cooling the fluid flowing to the displacement volume of at least one other of said at least two stages to a third temperature below said second temperature;

(d) reducing the temperature of the pre-cooled fluid in the displacement volume of said at least one stage to a fourth temperature below said second temperature;

(e) reducing the temperature in the displacement volume of said at least one other stage to a fifth temperature below said third temperature;

(f) supplying return fluid at reduced pressure and at said fourth temperature for flow from the displacement volume of said at least one stage back through said input channel to a compressor system, said return fluid being in heat exchange relationship with and thereby cooling a portion of the structure of said system;

(g) supplying return fluid at reduced pressure at said fifth temperature for flow from the displacement volume of said at least one other stage through an output channel to said compressor system, said return fluid being in heat exchange relationship with fluid flowing in said input channel;

(h) providing fluid from said compressor system under pressure for the periodic introduction thereof into said input channel;

whereby fluid flowing in said input channel under pressure to said at least one stage is pre-cooled in step (b) to said second temperature by regenerative cooling due to heat exchange relationship with said cooled portion of the structure and by counterflow cooling due to heat exchange relationship with the return fluid in said output channel and whereby fluid flowing in said input channel under pressure to said at least one other stage is precooled in step (c) primarily by counterflow cooling due to heat exchange relationship with the return fluid in said output channel.

2. A method of producing a cold environment using a plurality of stages of operation of a refrigerant system, a first set of warm stages operating above a nominal operating temperature and a second set of cold stages operating below said nominal operation temperature; said method comprising the steps of:

(a) periodically introducing into an input channel of said system a fluid under pressure at a first temperature for supply to displacement volumes in said sets of warm and cold stages;

(b) pre-cooling the fluid flowing to the displacement volumes of said warm stages to a second set of temperatures below said first temperature;

(c) pre-cooling the fluid flowing to the displacement volumes of said cold stages to a third set of temperatures below said second set of temperatures;

(d) reducing the temperatures of the pre-cooled fluid in the displacement volumes of said warm stages to a fourth set of temperatures below said second set of temperatures;

(e) reducing the temperatures in the displacement volumes of said cold stages to a fifth set of temperatures below said third set of temperatures;

(f) supplying return fluid at reduced pressures and temperatures for flow from the displacement volumes of said warm stages back through said input channel to a compressor system, said return fluid being in heat exchange relationship with and thereby cooling a portion of the structure of said system;

(g) supplying return fluid at reduced pressures and temperatures for flow from the displacement volumes of said cold stages through an output channel to said compressor system, said return fluid being in heat exchange relationship with fluid flowing in said input channel;

(h) providing fluid from said compressor system under pressure for the periodic introduction thereof into said input channel;

whereby fluid flowing in said input channel under pressure to the displacement volumes of said warm stages is pre-cooled in step (b) to said second set of temperatures by regenerative cooling due to heat exchange relationship with the cooled portion of that structure and by counterflow due to heat exchange relationship with the return fluid in said output channel and whereby fluid flowing in said input channel under pressure to the displacement volumes of said cold stages is pre-cooled in step (c) primarily by counterflow cooling due to heat exchange relationship with the return fluid in said output channel.

3. A method of producing a cold environment using three stages of operation of a refrigerant system, said method comprising the steps of:

(a) periodically introducing into an input channel of said system a fluid under pressure at a first temperature for supply to displacement volumes in said three stages;

(b) pre-cooling the fluid flowing to the displacement volume of the first and second of said three stages to second and third temperatures, respectively, below said first temperature;

(c) pre-cooling the fluid flowing to the displacement volume of said third stage of said three stages to a fourth temperature below said second and third temperatures;

(d) reducing the temperatures of the pre-cooled fluid in the displacement volumes of said first and second stages to fifth and sixth temperatures, respectively, below said second and third temperatures, respectively;

(d) reducing the temperature in the displacement volume of said third stage to a seventh temperature below said fourth temperature;

(e) supplying return fluid at reduced pressures and at said fifth and sixth temperatures for flow from the displacement volumes of said first and second stages back through said input channel to a compressor system, said return fluid being in heat exchange relationship with and thereby cooling a portion of the structure of said system;

(f) supplying return fluid at reduced pressure and at said seventh temperature for flow from the displacement volume of said third stage through an output channel to said compressor system, said return fluid being in heat exchange relationship with fluid flowing in said input channel;

(g) providing fluid from said compressor system under pressure for the periodic introduction thereof into said input channel;

whereby fluid flowing in said input channel under pressure to the displacement volumes of said first and second stages is pre-cooled in step (b) by regenerative cooling due to heat exchange relationship with the cooled portion of the structure and by counterflow cooling due to heat exchange relationship with the return fluid in said output channel and whereby fluid flowing under pressure to the displacement volume of said third stage is pre-cooled in step (c) primarily by counterflow cooling due to heat exchange relationship with the return fluid in said output channel.

4. A method for producing a cold environment in a refrigerant system comprising the steps of (a) periodically providing fluid under pressure from a compressor system to a plurality of variable displacement volumes via an input channel;

(b) pre-cooling said pressurized fluid by regenerative cooling and by counterflow cooling as it is supplied to at least one of said displacement volumes;

(c) pre-cooling said fluid primarily by counterflow cooling as it is supplied to a least one other of said displacement volumes;

(d) further reducing the temperature of the pre-cooled fluid supplied to said at least one displacement volume and returning said reduced temperature fluid to said compressor system back through said input channel said reduced temperature fluid cooling a portion of the structure of said system to provide for the regenerative cooling in step (b);

(e) further reducing the temperature of the pre-cooled fluid supplied to said at least one other displacement volume and supplying said further reduced temperature fluid to said compressor system through an output channel, said further reduced temperature fluid providing for the counterflow cooling of fluid in steps (b) and (c).

5. A method in accordance with claim 2 wherein said nominal operating temperature is about 20° K.

6. A method in accordance with claim 1 and further including the step of preventing maldistribution of the flow of fluid in said output channel.

7. A refrigerant system for producing a cold environment comprising fluid compression means for supplying fluid under pressure;

a plurality of successive operating stages having variable displacement volumes;

volume-changing means for varying the volumes of said displacement volumes;

an input channel having a heat exchange relationship with said volume-changing means for permitting flow of fluid to and from said successive displacement volumes, first means for permitting fluid to be introduced under pressure from said fluid compression means into said input channel for flow therein to said successive displacement volumes;

second means for permitting return fluid flowing in said input channel from said displacement volumes at reduced pressure to be removed from said input channel for flow to said fluid compression means;

an output channel for permitting flow of fluid to said fluid compression means, said fluid having a heat exchange relationship with fluid flowing in said input channel;

third means for permitting fluid at reduced pressure to flow from said at least a final one of said displacement volumes into said output channel;

said volume changing means increasing said displacement volumes after fluid under pressure has been supplied thereto so as to reduce the pressures and the temperatures of the fluid in said displacement volumes;

said volume-changing means subsequently decreasing said displacement volumes for causing return fluid at reduced temperatures and at reduced pressures to flow back through said input channel from a first set of said displacement volumes to said second means in heat exchange relationship with and thereby cooling at least a portion of said volume changing means and for causing return fluid at reduced temperature and at reduced pressure to flow from at least said final one of said displacement volumes to said third means;

whereby fluid flowing from said fluid compression means under pressure in said input channel to said first set of displacement volumes is pre-cooled by regenerative heat exchange with said portion of said volume-changing means and by counterflow heat exchange with fluid flowing in said output channel and fluid flowing in said input channel to said least said final one of said displacement volumes is pre-cooled by counterflow heat exchange with fluid flowing in said output channel.

8. A system in accordance with claim 7 wherein said volume-changing means includes a piston operable to vary said displacement volumes and a reciprocating work absorbing mechanism for driving said piston.

9. A system in accordance with claim 7 wherein said volume-changing means includes a pressure-balanced displacer operable to vary said displacement volumes and a displacer mechanism for driving said displacer.

10. A system in accordance with claim 7 wherein said volume-changing means includes a pressure-balanced displacer operable to vary said displacement volumes and a power piston separated from said displacer by a working volume, said power piston periodically compressing and expanding said fluid in said working volume and said displacement volumes.

11. A system in accordance with claim 10 wherein said power piston and displacer operate at substantially the same frequency, but out-of-phase with each other.

12. A system in accordance with claim 7 wherein said first means includes a valve operating at or near room temperature.

13. A system in accordance with claim 12 wherein said second means includes a valve operating at or near room temperature.

14. A system in accordance with claim 13 wherein said third means includes a valve operating substantially below room temperature.

15. A system in accordance with claim 14 wherein said third means further includes a surge volume between said valve and said output channel so that fluid flows into said output channel at a substantially constant reduced pressure.

16. A system in accordance with claim 7 and further including flow distributing means in said output channel for preventing maldistribution of the flow of fluid therein.

17. A system in accordance with claim 15 and further including flow distributing means for preventing maldistribution of flow in said output channel, said surge volume means and said flow distributing means assuring a substantially constant flow rate of fluid flowing in said output channel.

* * * * *